US005991957A

United States Patent [19]

Watanabe

[11] Patent Number: 5,991,957

[45] Date of Patent: Nov. 30, 1999

[54] TOOTHBRUSH

[75] Inventor: Takayuki Watanabe, Nishigou-mura, Japan

[73] Assignee: McNeil-PPC, Inc., Skillman, N.J.

[21] Appl. No.: 09/081,375

[22] Filed: May 19, 1998

[30] Foreign Application Priority Data

May 23, 1997 [JP] Japan ..... 9-148425

[51] Int. Cl.[6] ..... A46B 9/04

[52] U.S. Cl. ..... 15/167.1; 15/207.2; 15/DIG. 5; 15/DIG. 6

[58] Field of Search ..... 15/167.1, 207.2, 15/DIG. 5, DIG. 6

[56] References Cited

U.S. PATENT DOCUMENTS

| | | | |
|---|---|---|---|
| 2,317,485 | 4/1943 | Rider | 15/207.2 X |
| 2,876,477 | 3/1959 | Stewart | 15/167.1 |
| 3,613,143 | 10/1971 | Muhler et al. | 15/207.2 X |
| 4,263,691 | 4/1981 | Pakarnseree | 15/207.2 |
| 4,571,768 | 2/1986 | Kawashima | 15/207.2 X |
| 5,137,039 | 8/1992 | Klinkhammer | 132/308 |
| 5,850,660 | 12/1998 | O'Halloran | 15/207.2 X |

FOREIGN PATENT DOCUMENTS

| | | | |
|---|---|---|---|
| 0 663 162 | 7/1995 | European Pat. Off. . | |
| 5-123222 | 5/1993 | Japan | 15/167.1 |
| 94/09677 | 5/1994 | WIPO . | |
| 96/09781 | 4/1996 | WIPO . | |

*Primary Examiner*—Mark Spisich
*Attorney, Agent, or Firm*—Lawrence D. Schuler

[57] ABSTRACT

In the case of conventional toothbrushes whose bristles have all needlelike tapering tips, the bristles near the tips become too thin and too flexible. In the case of toothbrushes whose bristle ends are all round or hemispherical, it is difficult to get into the spaces between teeth or boundary spaces between teeth and gums.

Thus, it is difficult for conventional toothbrushes to clean up in every nook and corner in the mount. A toothbrush comprising a block head having brush portion, a handle and a neck portion connecting the block head with the handle, wherein a part of the tufts of the brush portion are made up of filament with polygonal cross section, and the rest of the tufts are made up of sheath-core structural filament whose core material is covered with sheath material such that the filaments are circular in cross-section, with the sheath material being concentric to the core material.

10 Claims, 7 Drawing Sheets

TOOTHBRUSH

TECHNICAL FIELD OF THE INVENTION

This invention aims to provide a toothbrush which can effectively remove plaque on surfaces such as between teeth or between teeth and gums where plaque is easy to accumulate and at the same time can massage gums.

BACKGROUND OF THE INVENTION

Toothbrushing has become an established custom for public people in everyday lives in recent years. Toothbrushing aims to prevent dental caries, periodontitis and foul breath and to massage gums, and is widely accomplished by using a toothbrush. Toothbrushes are used to remove plaque adhered to teeth as well as food residue between teeth and to massage gums as well. For conventional toothbrush filaments, mainly monofilament made of uniform resin with round cross-sectional shape has been used. Concerning tip shape of such monofilaments, hemispherical or tapering shape is known. Further, toothbrushes are known which use filaments with only one tip shape or two or more tip shapes for individual tufts which are embedded in tuft holes on the blockhead of the toothbrush.

Further, many kinds of toothbrushes have been further developed, for example, there are toothbrushes designed to remove effectively plaque adhered to tooth surfaces, surfaces between teeth, those between teeth and gums, on molars and so forth or food residue. Toothbrush bristles have been designed in various shapes such as flat cut, angular cut (Japanese Laid-open Utility Model 106522/87), mountain shape cut (Japanese Laid-open Utility Model 82023/91), different level double surface cut, etc. Since filament materials which will not hurt teeth or gums and can effectively remove plaque are preferred for toothbrushes, nylon resins are generally used as filament material of bristles. However toothbrushes are known which use polybutylene terephthalate alone or two materials jointly (Japanese Laid-open Utility Model 81355/77, Japanese Laid-open Utility Model 31837/83) as the bristle material. Toothbrushes are known which use bristles with the same diameter or with two or more diameters (Japanese Laid-open Utility Model 121431/89). Toothbrushes are known in which the filament tips have hemispherical (Japanese Laid-open Utility Model 97923/86) or tapering shapes (Japanese Laid-open Utility Model 31837/83).

As public interest in oral care grows strong in recent years, a number of toothbrushes have been developed, as shown above, to remove effectively plaque which will cause carious teeth or periodontitis. However in the case of toothbrushes whose bristles have all needle like tapering tips to remove plaque adhered to the surface between teeth and gums, because the bristles near tips becomes too thin and too flexible, the bristle tips lose their stiffness necessary to remove plaque sufficiently, and the purpose of toothbrushes to prevent periodontitis cannot be attained after all.

On the other hand, toothbrushes whose bristle ends are round or hemispherical are suitable to clean flat surfaces of teeth or to massage gums. However, it is difficult for such toothbrushes to remove plaque between teeth or in boundary spaces between teeth and gums because the bristle tips are too thick to enter such boundary spaces and reach the plaque therein. That is, it is difficult for conventional toothbrushes having bristles with the same tip shape or those having different tip shapes to clean up in every nook and corner in the mouth.

SUMMARY OF THE INVENTION

This invention provides a toothbrush which is effective to prevent carious teeth or periodontitis and which can more easily and effectively clean up in every nook and corner in the mouth than conventional toothbrushes. A toothbrush according to the present invention can remove plaque and food residue adhered to surfaces between teeth, between teeth and gums and occlusal surfaces and give a proper stimulus to gums by massaging to improve the circulation of the blood.

BRIEF DESCRIPTION OF THE DRAWINGS

In the drawings,

FIG. 4(*a*) shows trigonal filaments,

FIG. 4(*b*) shows tetragonal filaments,

FIG. 4(*c*) shows hexagonal filaments, and

FIG. 4(*d*) shows octagonal filaments.

FIG. 4(*e*) illustrates conventional filaments having round cross section.

FIG. 5(*b*) illustrates a longitudinal section.

EMBODIMENT OF THE INVENTION

The present invention relates to a toothbrush whose bristles are composed of filaments with polygonal cross-section being densely embedded along the periphery of the blockhead. Using the filaments with polygonal section makes it possible to clean up effectively flat surfaces of teeth and give a proper massage effect to gums by utilizing the angular shape of the polygon. When the polygonal filaments are arranged along the periphery of the blockhead in particular, the above effects can be obtained without making every filament polygonal because the angular shape of the side of the filament will work effectively. Further the polygonal filaments can be packed densely in a limited narrow space.

In the present invention the sectional shape of the polygonal filament can be any polygon, such as trigon, tetragon, pentagon, hexagon, octagon, and so forth. In particular, polygons such as trigon, tetragon, pentagon, hexagon, octagon, and so forth which are angular and do not form space when they are embedded are preferred, and more preferred is hexagon because a hexagon has many angles and can form a honeycomb structure. The tip of the polygonal filament is preferably of a round shape or hemispherical shape. By making the tip hemispherical, a better gum massaging effect is provided.

The polygonal filament of the present invention can be produced by any known methods and can be easily obtained from du Pont under the trademark of "Tynex" hexagonal filament.

The material of the polygonal filament can be, for example, nylon, polyethylene terephthalate and polybutylene terephthalate, but the material is not limited thereto.

The thickness of the polygonal filament is not in particular restricted, however 0.1 to 0.5 mm in maximum dimension is preferred and 0.13 to 0.3 mm in maximum dimension is more preferred.

The tip of the polygonal filament is preferably processed into round shape or hemispherical shape. The process can be done either before or after tuft embedment. This process can be performed by, for example, a filament tip rounding treatment but is not limited thereto.

Figure 6A:
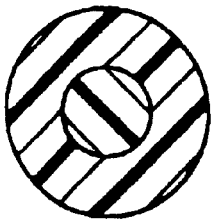
FIG. 6(*a*) illustrates a cross section of a sheath-core structural filament, and FIG. 6(*b*) illustrates a longitudinal section.
Figure 6B:
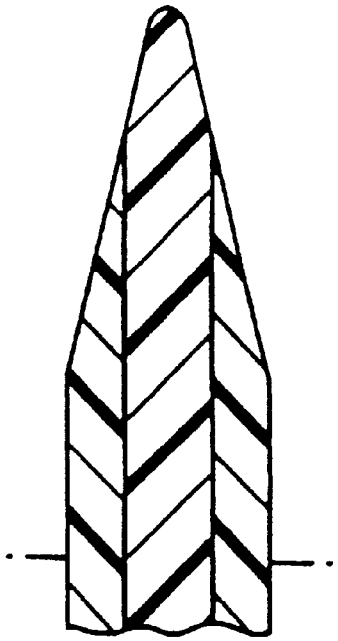
Figure 9A:
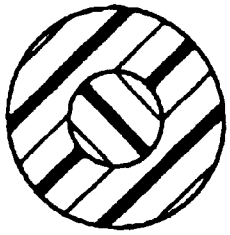
FIG. 9(*a*) illustrates a cross-section of another embodiment of a sheath-core structural filament whose thickness smoothly reduces from the root portion having constant thickness toward the tip, and FIG. 9(*b*) illustrates a longitudinal section thereof.
Figure 9B:
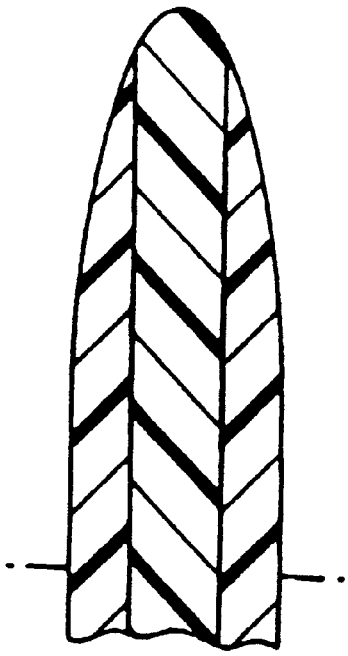

Another characteristic of the present invention is to embed sheath-core structural filament which has its sheath material arranged around its core material so that the filament cross-section is concentric circles where the material of the core is different from that of the sheath. Such a sheath-core structural filament can exert respective functions of the sheath and core materials because of the difference in their physical properties. That is to say, when the tip of the sheath-core structural filament is processed to a tapering or circular cone shape, the harder core material of the filament tip can effectively clean surfaces between teeth, boundary surfaces of teeth and gums and occlusal surfaces. The use of a softer material for the sheath portion prevents bending of the harder core material and further facilitates the tip to reach into uneven portions of the surface between teeth, boundary surface of teeth and gums and occlusal surfaces. When such sheath-core structural filaments are embedded in the central section of the block head, the above-mentioned effects can be obtained even if not all the filaments have a sheath-core structure. In the present invention, the tapering shape or circular cone shape includes, as shown in FIG. 9(*b*), the shape whose diameter smoothly decreases from the root portion having constant diameter toward the tip without forming an edge such as an ellipsoid of revolution as well as the shape forming an edge between the root portion and the circular cone portion such as the shape shown in FIG. 6(*b*). Material of the sheath-core structural filament can be, for example, polyamides such as nylon; polyesters such as polyethylene terephthalate and polybutylene terephthalate, but are not limited thereto. It is preferable to use a harder material for the core than the sheath. Such combination is, for example, polybutylene terephthalate for the core and nylon for the sheath.

The sheath-core structural filament of the present invention can be produced by any known method.

The tip of the sheath-core structural filament is preferably processed into tapering shape or circular cone shape. The process can be done either before or after tuft embedment. This processing can be performed by, for example, a filament tip rounding treatment. Other processes can be used for this purpose.

The method of embedding tufts composed of such filaments is not particularly restricted. Materials of the block head, neck portion and handle of the toothbrush in this invention are not particularly limited. Useful materials are nylon, polyethylene terephthalate, polybutylene terephthalate, polyimides, polycarbonates, polyacetal, ABS (Acrylonitrile-Butadiene-Styrene copolymeric resin), etc.

The inventors have unexpectedly found that by embedding two kinds of filaments on a blockhead, the effects of different filaments do not cancel each other; instead both filaments exert their respective functions synergistically. To enhance such effects, it is preferred that bristles of polygonal filaments are embedded in the outer line of tuft holes on said block head and the sheath-core structural bristles are embedded in the central section of the block head.

Tufts of the sheath-core structural filament and those of the polygonal filament of the toothbrush preferably form 3 to 6 lines, in particular 3 to 5 lines, arranged in the width direction of the block head. If there are less than 3 lines, the effect of using the polygonal filament and the sheath-core structural filament jointly cannot be attained. More than 6 lines are not preferred because of the difficulty of tuft embedment and because the blockhead must be widened.

The bristle lengths of the outermost lines are preferably shorter than those of the inner lines, which is one to three or four lines. Thereby plaque on the surfaces between teeth or between teeth and gums can be effectively removed. Further, the bristles of the inner lines are cut to form continuous six or more cut surfaces lined in the longitudinal direction. Thereby it is possible to adjust the plaque removal performance of the brush on the dentition.

In said six cut surfaces of the toothbrush, the bristles of the first cut surface nearest to the brush end are preferably cut so that the brush end bristle is shortest and the bristles lengthen toward the handle at an angle to the block head surface of 15° to 50° at the brush end, preferably 20° to 30°, then at the first to third bristle row from the brush end, preferably the third row, replaced without difference in level by second cut surface which forms the first top horizontal cut surface.

The bristles of the third cut surface continuing from the second cut surface become short from the handle side of the second cut surface at an angle 15° to 50° to the block head surface, preferably 20° to 30°, to form the bottom at the third to sixth row from the brush end, preferably fourth and fifth row. The bottom can be, for example, a cross line of the third cut surface and fourth cut surface and a flat plane or curved plane formed between the third cut surface and fourth cut surface approximately parallel to the block head surface.

Figure 1A:
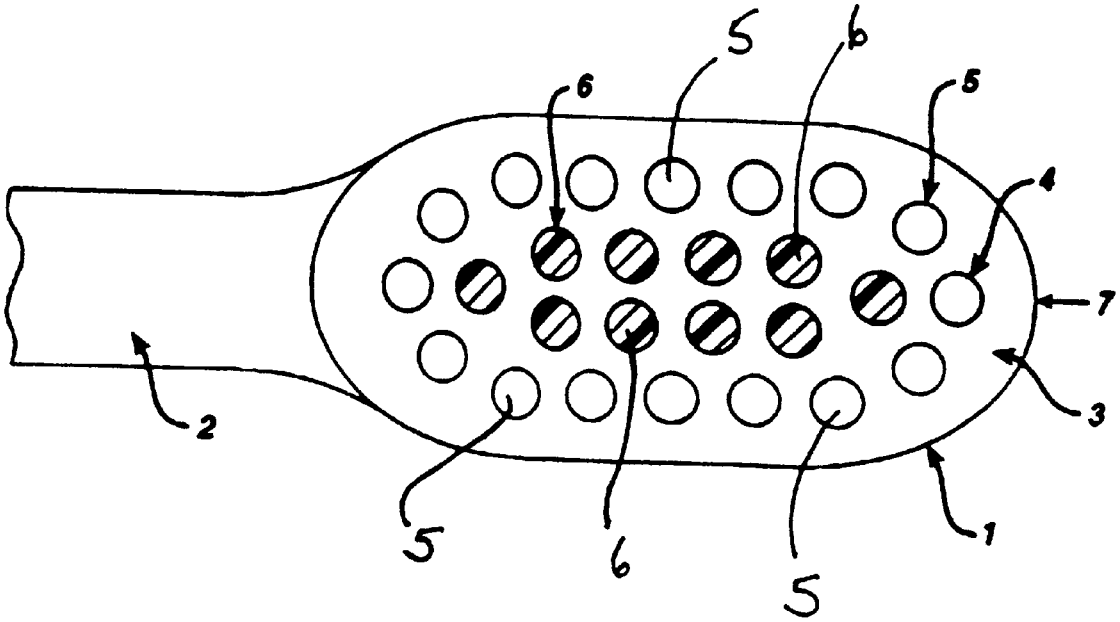
FIG. 1(*a*) is a plan view of a blockhead of a toothbrush in accordance with the present invention, and FIG. 1(*b*) is a side view thereof.
Figure 1B:
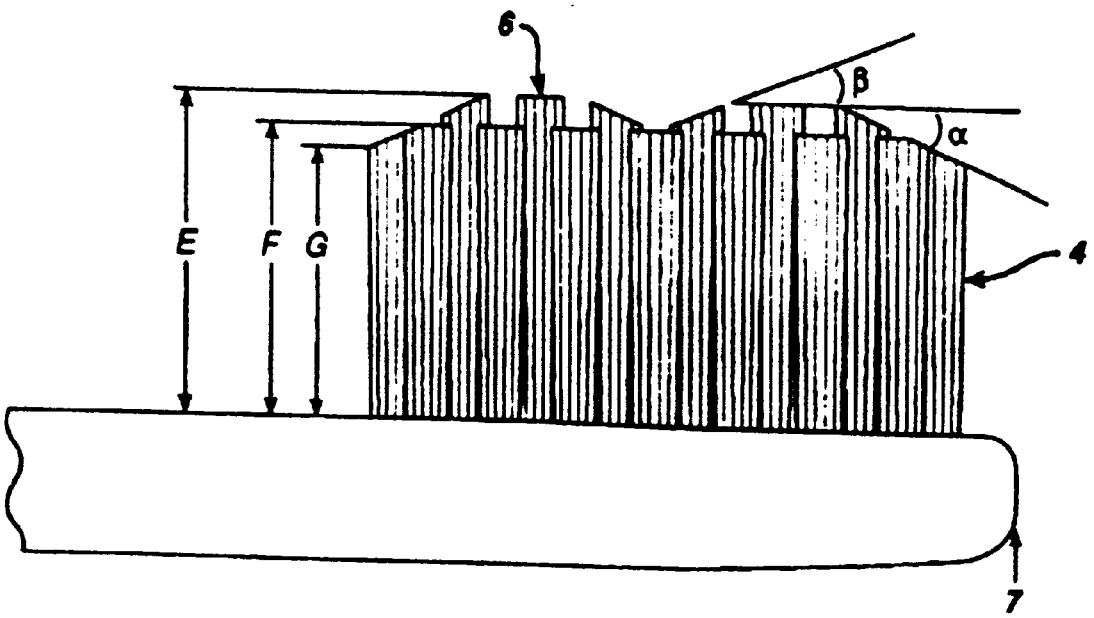
Figure 2:
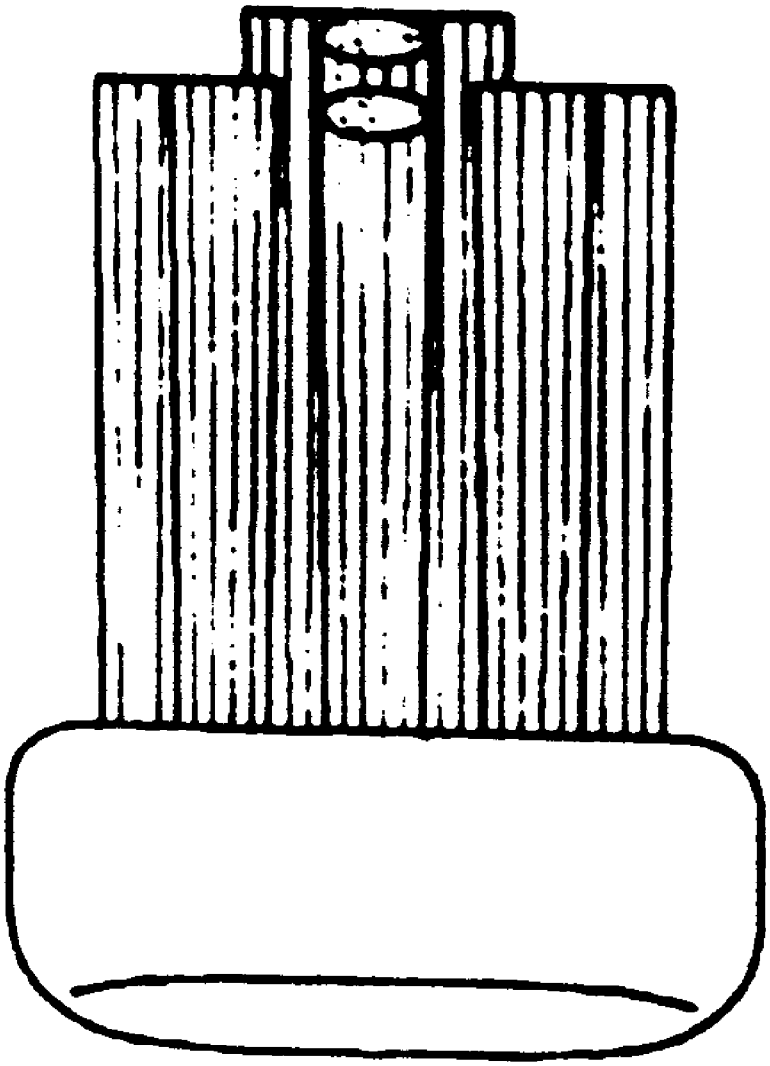
FIG. 2 is a front view of the brush portion and blockhead of a toothbrush in accordance with the present invention.

The fourth, fifth and sixth cut surfaces can be symmetrical to the first, second and third cut surfaces about the perpendicular plane including the block head and said bottom line as shown in FIG. 1(*b*), however they are not restricted thereto and their longitudinal length can be changed. In such cases, the bristle lengths of the fourth cut surface preferably corresponds to those of the third cut surface, likewise the fifth to the second and the sixth to the first.

The ratio of the height of the top horizontal cut surface: E to the height of the bottom: F is; E/F=1.05 to 1.2, and the ratio of the height of the top horizontal cut surface: E to the height of lowest part of first cut surface: G is; E/G=1.1 to 1.3. By adopting the ratio in such range, high plaque removability is realized.

The bristle lengths of the tufts embedded in the outer lines are not restricted in particular as long as the above said conditions are satisfied. However, the surface formed by the tips of the bristles embedded in the outer lines is preferably parallel to the block head surface and the bristle length thereof is about the same as that of the bottom.

Preferably the bristle length of the first top horizontal cut surface is substantially the same as that of the second top horizontal cut surface.

In the toothbrush of the present invention, the densely packed tufts arranged in lines along the periphery of the block head effectively clean up the flat surface of teeth and massage gums due to the effect of their sharp angular filaments. The hard material of the filament core having circular cone-shaped tips in the central section of the block head and enclosed by the polygonal filament bristles or sandwiched between the two outer lines of polygonal filaments effectively clean up the surfaces between the teeth, the boundary surfaces between teeth and gums and between occlusal surfaces. The soft material of the sheath prevents bending of the hard material of the core to facilitate the tip reaching the surfaces between teeth, boundary surfaces between teeth and gums and occlusal surfaces. By embedding two kinds of filaments having different tip shapes at appropriate areas on the block head and by cutting the shape of the bristles to conform to the dentition, the toothbrush can easily and effectively clean in every nook and corner in the mouth.

The toothbrush of the present invention has excellent durability and the bristles of polygonal filaments having rounded tips effectively remove plaque adhered to the flat surfaces of the teeth while massaging the gums during brushing. Furthermore, the tufts of sheath-core structural filaments having circular cone-shaped tips in the central section of the block head and surrounded by the polygonal filament tufts or sandwiched between two outer lines of polygonal filament tufts freely reach the surfaces between teeth, the boundary surfaces between teeth and gums and the occlusal surfaces and effectively remove plaque adhered thereto and therebetween without harming teeth or gums.

EXAMPLES

The present invention will be illustrated according to the following Examples. In FIG. 1(*a*), a number of tufts, including the tufts 4 and 5, are composed of a plurality of filaments having a hexagonal cross-section and round-shaped tips. These tufts, capable of being densely packed owing to the cross-sectional shape of their filaments, are embedded along the periphery of the blockhead 1. A number of tufts, including tuft 6, are composed of sheath-core structural filaments. The tufts composed of sheath-core filaments are surrounded by said hexagonal filament tufts and are embedded in the central portion of the brush. The bristle length of the hexagonal filament tufts does not exceed the bristle length of the sheath-core structural filament tufts. The sheath-core filaments are embedded in the central section of the brush and are made of two different materials. The sheath-core filaments are circular in cross-section, the outer sheath material being concentric with and surrounding the inner core material. Further, the tufts in the central portion of the brush composed of the sheath-core structural filaments (including tuft 6 in FIG. 1(*b*)) are cut to form six cut surfaces arranged along the longitudinal direction of the brush. After cutting the tufts of the central portion (including tuft 6), the tips of the hexagonal filament bristles along the periphery of the block (including those of tufts 4 and 5) were rounded and the tips of the sheath-core structural filament bristles in the central portion were tapered to a circular or cone shape.

The hexagonal filament in the Example was 7.8 mil (0.2 mm) in thickness and was made of extruded nylon.

The bristle length of the hexagonal filament in this Example was uniformly 10 mm. The core material of the sheath-core structural filament was polyethylene terephthalate, the sheath material thereof was polyamide and the filament diameter was 0.2 mm.

Figure 3A:
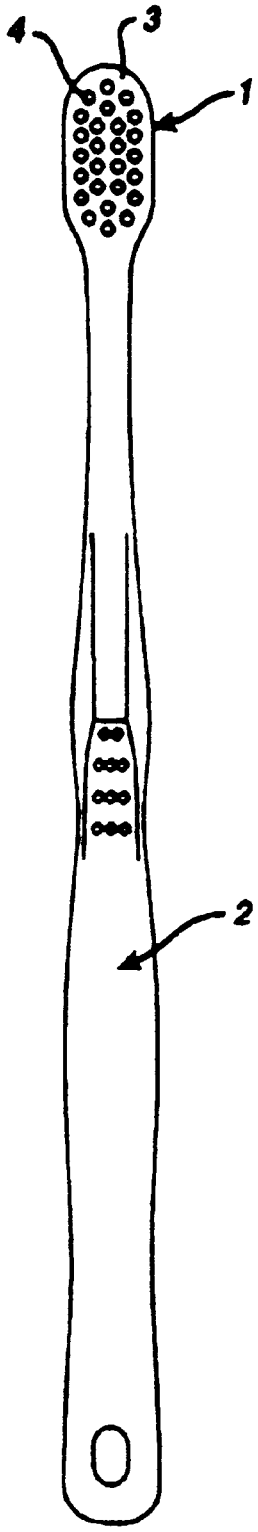
FIG. 3(*a*) is a plan view of a toothbrush in accordance with the present invention, and FIG. 3(*b*) is a side view thereof.
Figure 3B:
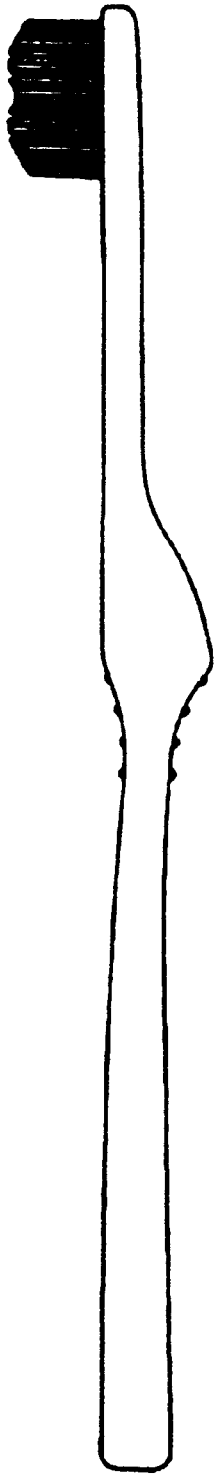
Figure 4A:
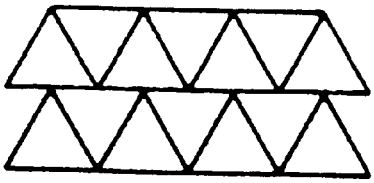
FIGS. 4(*a*) to 4(*d*) each illustrates a portion of a cross-sectional view showing densely-packed polygonal filaments.
Figure 4B:
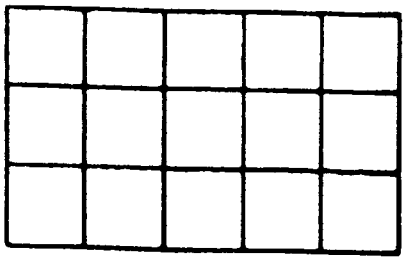
Figure 4C:
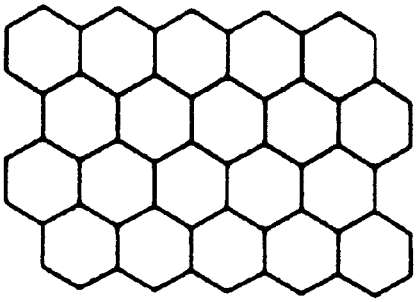
Figure 4D:
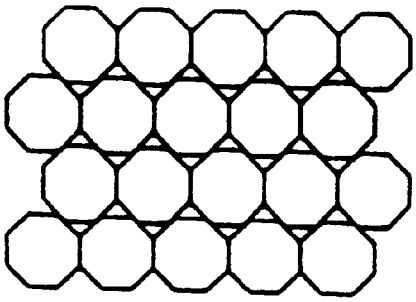
Figure 4E:
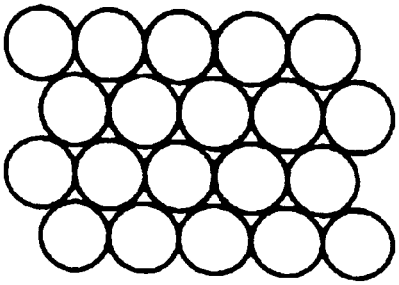
Figure 5A:
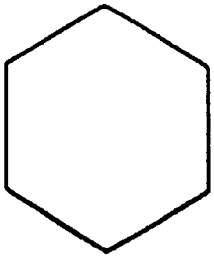
FIG. 5(*a*) illustrates a cross section of a hexagonal filament.
Figure 5B:
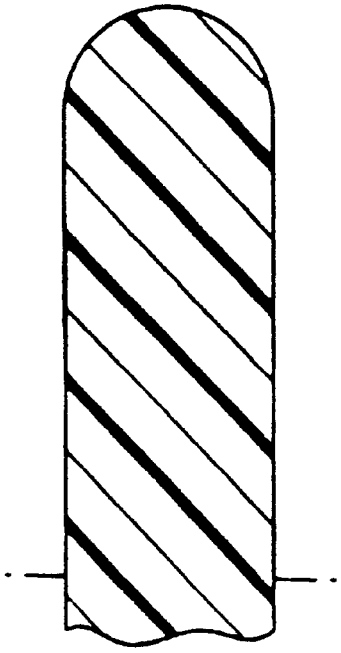

The cut shape of the sheath-core structural filaments is shown in FIG. 1(*b*). After cutting, the tips of the polygonal filaments were rounded to hemispherical shape. Further the tips of the sheath-core structural filaments were processed to tapered or circular cone shape. The test for plaque removability was performed using a toothbrush shown in FIGS. 3(*a*) and 3(*b*) made according to the Example. This brush was tested against two controls available commercially, brush A (Dental-H (trademark) from Johnson & Johnson K.K.) and brush B ("DS" toothbrush from L. K.K.) as follows:

30 subjects were selected having healthy gums and no recognized gum involution or irregular dentition and having more than 20 teeth to be tested except for prosthetic teeth and dental caries in the mouths.

The teeth to be tested were scaled and polished seven days before the test started and the tooth condition was plaque-scored as 0. The toothbrush to be tested was designated for each subject and subjects were taught how to brush their teeth. All oral care was stopped for 24 hours from the time the test started and the subjects' teeth were evaluated for plaque accumulation. After the evaluation, subjects started brushing their teeth using their designated toothbrushes under the investigation of an evaluator, and thereafter the plaque accumulation condition was measured. The same procedure was performed for the other two toothbrushes. Evaluations were done once each week.

The test order of toothbrush for each subject was changed considering learning of the brushing method of subjects.

Figure 8:
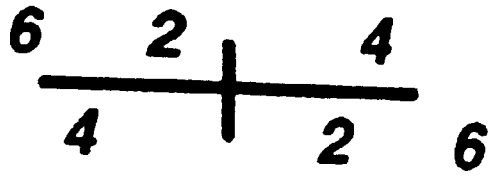
FIG. 8 illustrates positions of teeth on which plaque removability was evaluated.

Plaque accumulation was evaluated using liquid PROSPEC (GC Company) dye according to Plaque Control Record (O'Leary 1978, PCR). For the test positions, teeth in the mouth were divided into six sections inside surface and outside surface respectively considering plaque distributing parts (neighboring surface, neck portion of teeth 1/3) as shown in FIG. 8. In other words, plaque accumulation on the following teeth was evaluated: the second and sixth teeth on the left side from the center of the upper jaw, the fourth tooth on the right side therefrom, the fourth tooth on the left side from the center of the lower jaw and the second and sixth teeth from the right side therefrom.

Information as to pain in the gums, handleability, etc. was gathered by questionnaires. Brushing method was according to scrubbing method, at least 6 sections for outer tooth surfaces and at least 5 sections for inner tooth surfaces were brushed, and brushing was done at least ten times for each section and for a total of five minutes per brushing.

Figure 7:
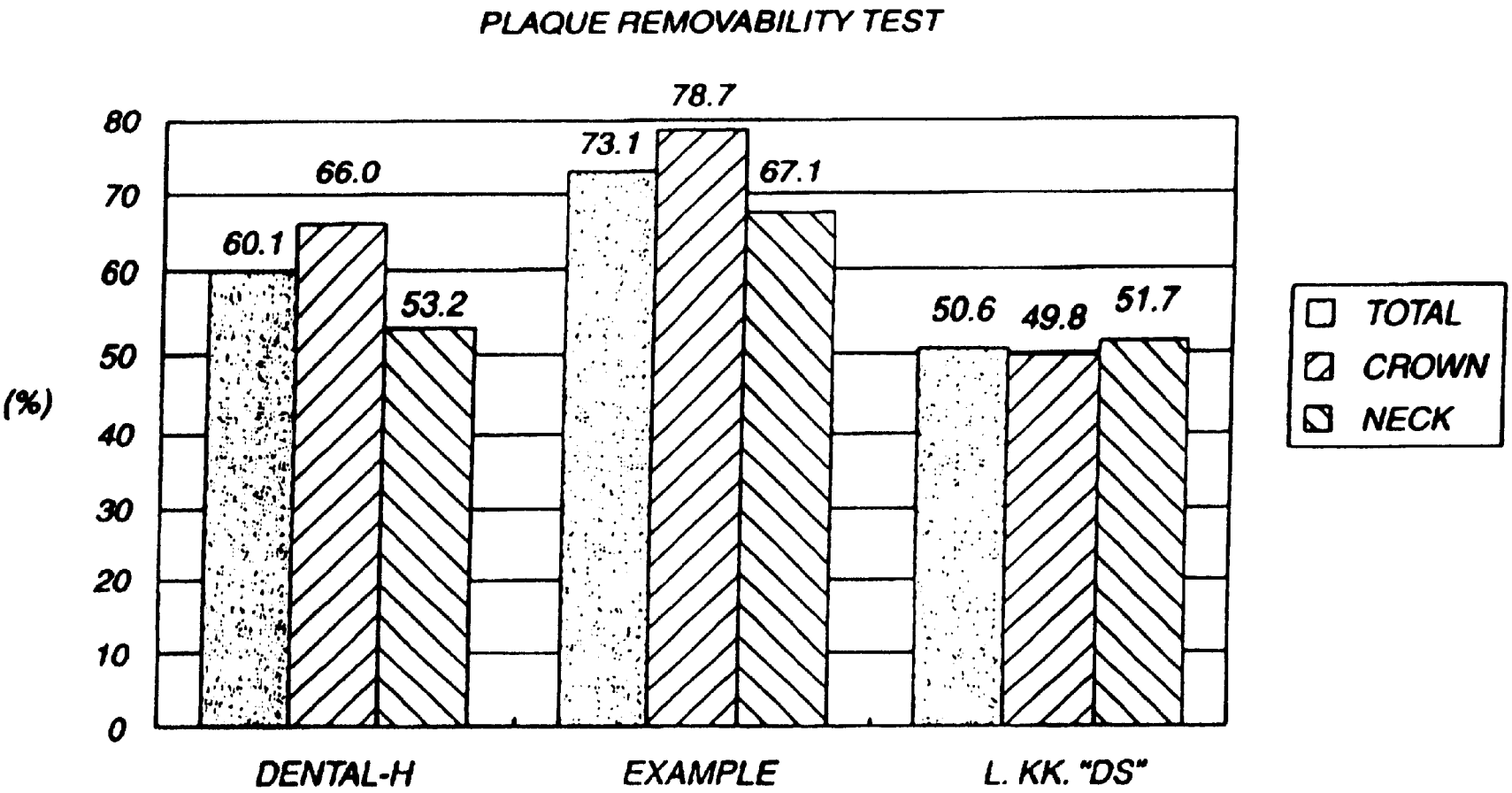
FIG. 7 shows bar graphs summarizing results of plaque removability tests.

Test Results:

The results are shown in FIG. 7. The toothbrush of the present invention showed excellent plaque removability in the evaluations at the crown and neck of teeth as well as total evaluation.

Effect of the Invention

In the present invention, tufts of polygonal filament having round tips arranged around the periphery of the block head effectively clean the flat surfaces of teeth and massage the gums due to the cross sectional shape of the filament. The hard material of the filament cores having circular cone ends embedded in the central section of the block head and surrounded by the polygonal filament tufts or sandwiched between the two outer lines of polygonal filament tufts effectively clean up the surfaces between teeth, boundary surfaces between teeth and gums and occlusal surfaces. The soft material of the sheath prevents bending of the hard material of the core to facilitate the tips to reach the surfaces between teeth, boundary surfaces between teeth and gums and occlusal surfaces. That is to say, by using two kinds of filaments having different tip shapes and embedding them at the indicated position on the block head, their respective function and effect can be realized. By cutting the bristles to conform to dentition, the toothbrush can easily and effectively clean up in every nook and corner in the mouth.

Description of Symbols

1 . . . block head, 2 . . . handle, 3 . . . block head surface, 4 and 5 . . . tufts of polygonal filaments, 6 . . . tuft composed of sheath-core structural filament, 7 . . . brush end, α . . . angle of the first cut surface to the block head surfaces, β . . . angle of the third cut surface to the block head surface.

What is claimed is:

1. A toothbrush comprising a block head having a brush portion composed of tufts embedded on the block head, a handle and a neck portion connecting said block head with the handle, wherein a first group part of said tufts are made up of filaments with a polygonal cross section, and a second group of tufts are made up of sheath-core structural filaments whose core material is covered with sheath material so that the cross section thereof is concentric circles.

2. The toothbrush according to claim 1 wherein said tufts of polygonal filament are embedded in tuft holes which forms an outer line of tuft holes on said block head, and said tufts of the sheath-core structural filament are embedded in further tuft holes.

3. The toothbrush according to claim 1 wherein said tufts of polygonal filaments are embedded in tuft holes along the periphery of said block head and said tufts of the sheath-core structural filaments are embedded in further tuft holes so that the polygonal filament tufts surround the sheath-core structural filament tufts.

4. The toothbrush according to claim 1 wherein said polygon of the polygonal filament is selected from the group consisting of trigon, tetragon, pentagon, hexagon and octagon.

5. The toothbrush according to claim 1 wherein said polygon of the polygonal filament is hexagon.

6. The toothbrush according to claim 1 wherein said core part of the sheath-core structural filament is made of polyester resin and said sheath part thereof is polyamide resin.

7. The toothbrush according to claim 1 wherein the tips of the sheath-core structural filaments have a circular cone shape and the points thereof are made of polyester resin, and the tips of said polygonal filaments have a round shape.

8. The toothbrush according to claim 2 where the tufts comprise:

a) said tufts forming three to six lines along the width direction of the block head, b) the bristle lengths of the outermost lines are shorter than those of the inner lines of tufts, c) the bristles of said inner lines being cut so as to form at least six continuous cut surfaces along the longitudinal direction of the block head.

9. The toothbrush according to claim 1 where the tufts comprise:

a) said tufts forming three to five lines along the width direction of the block head, b) the bristle lengths of the outermost lines are shorter than those of the inner lines of tufts, c) the bristles of said inner lines being cut so as to form six continuous cut surfaces along the longitudinal direction of the block head, d) in the cut surfaces, the bristles of the first cut surface nearest to the brush block head free end being cut so that the bristles adjacent the block head free end are shortest and the bristles lengthen toward the handle at an angle with respect to the block head surface of 20° to 30° adjacent the block head free end to the second cut surface which forms a first top horizontal cut surface at the third bristle row from the block head free end without difference in level, e) the bristles of the third cut surface continuing from the second cut surface become short from the handle side of the second cut surface at an angle 20° to 30° to the block head surface to form the bottom, f) the fourth, fifth and sixth cut surfaces are symmetrical to the first, second and third cut surfaces about a plane perpendicular to the block head surface and intersecting said bottom, g) the ratio of the height of the top horizontal cut surface: E to the height of the bottom: F is; E/F=1.05 to 1.2, h) the ratio of the height of the top horizontal cut surface: E to the height of lowest part of the first cut surface: G is; E/G=1.1 to 1.3 and, i) the surface formed by the tips of the bristles of the outer rows is parallel to the block head surface and the bristle length thereof is about the same as that of the bottom.

10. The toothbrush according to claim 9 where the bristle lengths of the first and the second top horizontal cut surfaces are substantially the same.

* * * * *